US012251611B2

(12) United States Patent
Cook

(10) Patent No.: US 12,251,611 B2
(45) Date of Patent: Mar. 18, 2025

(54) BASKETBALL DRIBBLING TEACHING AID SYSTEM, METHOD, AND COMPUTER PROGRAM PRODUCT

(71) Applicant: Antonio Aundrey Cook, Huntsville, AL (US)

(72) Inventor: Antonio Aundrey Cook, Huntsville, AL (US)

( * ) Notice: Subject to any disclaimer, the term of this patent is extended or adjusted under 35 U.S.C. 154(b) by 225 days.

(21) Appl. No.: 18/062,342

(22) Filed: Dec. 6, 2022

(65) Prior Publication Data

US 2023/0173366 A1 Jun. 8, 2023

Related U.S. Application Data

(60) Provisional application No. 63/265,006, filed on Dec. 6, 2021.

(51) Int. Cl.
*A63B 69/00* (2006.01)
*A63B 71/06* (2006.01)

(52) U.S. Cl.
CPC ..... *A63B 69/0071* (2013.01); *A63B 71/0622* (2013.01); *A63B 2071/0694* (2013.01); *A63B 2214/00* (2020.08)

(58) Field of Classification Search
CPC ..... A63B 69/0071; A63B 71/0622; A63B 2071/0694; A63B 2214/00
USPC ..... 473/409, 422, 446, 447, 478, 479
See application file for complete search history.

(56) References Cited

U.S. PATENT DOCUMENTS

| | | | | |
|---|---|---|---|---|
| 3,629,869 | A | 12/1971 | Sweet | |
| 3,660,852 | A | 5/1972 | Schulenberg | |
| 6,280,352 | B1 | 8/2001 | Coffeen et al. | |
| 8,235,870 | B2 * | 8/2012 | Hamilton | A63B 21/4037 482/148 |
| 8,727,784 | B1 | 5/2014 | Wolf | |
| 8,998,752 | B2 * | 4/2015 | Parvanov | A63B 69/002 473/422 |
| 9,275,470 | B1 | 3/2016 | Forkosh et al. | |
| 9,381,420 | B2 | 7/2016 | Burroughs | |
| 9,486,692 | B2 | 11/2016 | Crowley et al. | |
| 10,010,778 | B2 | 7/2018 | Marty et al. | |
| 10,503,965 | B2 | 12/2019 | Smith | |
| 10,639,532 | B2 | 5/2020 | Jackson | |
| 2007/0219024 | A1 * | 9/2007 | Allegre | A63B 69/002 473/422 |
| 2008/0090681 | A1 | 4/2008 | Montie et al. | |
| 2008/0113831 | A1 | 5/2008 | Page et al. | |
| 2009/0117525 | A1 * | 5/2009 | Bavaro | A63B 69/002 434/247 |
| 2011/0207561 | A1 | 8/2011 | Adams | |
| 2014/0274484 | A1 * | 9/2014 | Parvanov | A63B 69/002 473/446 |
| 2016/0082340 | A1 | 3/2016 | Adams | |
| 2016/0121192 | A1 | 5/2016 | Mendoza | |
| 2016/0250539 | A1 | 9/2016 | Richardson | |

(Continued)

*Primary Examiner* — Nini F Legesse
(74) *Attorney, Agent, or Firm* — Dunlap Bennett & Ludwig, PLLC

(57) ABSTRACT

A system, method, and computer program product for teaching athletic ball skills is herein disclosed. The method includes the steps of providing a device with a graphical user interface (GUI) and a ball. It further includes the step of displaying a first number on the GUI. The method further includes the step of performing a first action with the ball based on the displayed first number.

11 Claims, 3 Drawing Sheets

(56) References Cited

U.S. PATENT DOCUMENTS

| | | | | |
|---|---|---|---|---|
| 2016/0279462 | A1* | 9/2016 | Sutherland | A63B 21/4037 |
| 2017/0151479 | A1 | 6/2017 | Marra | |
| 2021/0031089 | A1 | 2/2021 | Spont | |

* cited by examiner

BASKETBALL DRIBBLING TEACHING AID SYSTEM, METHOD, AND COMPUTER PROGRAM PRODUCT

CROSS-REFERENCE TO RELATED APPLICATION

This application claims the benefit of priority of U.S. provisional application No. 63/265,006, filed Dec. 6, 2021, the contents of which are herein incorporated by reference.

BACKGROUND OF THE INVENTION

The present invention relates to basketball teaching aids and, more particularly, to a systemic software application that teaches dribbling a basketball and helps with hand/ball coordination, reading, and recognizing movement methods.

Sports, such as basketball and soccer, are among the most popular games in the world and are enjoyed by hundreds of millions of fans. Various methods are used for training athletes. Typically, a drill with a specific skill is taught and practiced through repetition. As with most athletic activities, mastery of a plurality of skills to employ in a game situation is required to achieve a high level of success.

When learning how to dribble the basketball, people often will dribble with their heads down while looking at the ball. So, during the game, they tend to do the same (look down while dribbling), resulting in not passing the ball on time, lack of confidence with the ball, or delayed reaction with passing or scoring.

As can be seen, there is a need for a systemic software application that ameliorates these aforementioned issues. There is a need to develop better training methods that address the issues of limited court awareness, limited understanding of ball movement, and limited reading due to improper head/eye technique. The method described herein solves looking up while dribbling, brain clogging and reading, solves training players that speak different languages, solves cardio and focusing simultaneously.

SUMMARY OF THE INVENTION

In one aspect of the present invention, a ball dribbling training method is disclosed, and includes the steps of: providing a device with a graphical user interface; providing a ball; displaying a first number on the graphical user interface; and performing a first action with the ball based on the displayed first number.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
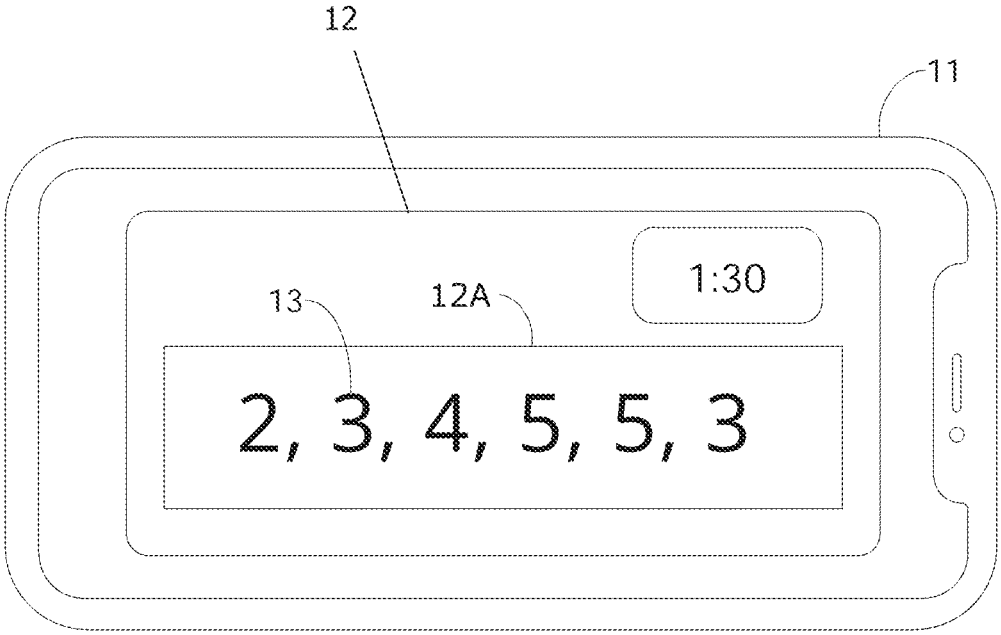
FIG. 1 is a schematic view of a user interface in accordance with an embodiment of the present invention.

With this overview in mind, and turning now to a more detailed discussion in conjunction with the attached figures, the techniques of the present disclosure are illustrated as being implemented in a computing device such as a PC, laptop, tablet, smartphone or other device capable of executing computer-executed instructions stored on a non-transient medium, e.g., memory, such as RAM, ROM, EPROM, flash memory and so on. Thus, the execution of steps in a process flow is by way of computer-execution of such steps, e.g., via a processor configured to retrieve the corresponding instructions from memory and execute them.

The following detailed description is of the best currently contemplated modes of carrying out exemplary embodiments of the present invention. The description is not to be taken in a limiting sense but is made merely for the purpose of illustrating the general principles of the present invention, since the scope of the present invention is best defined by the appended claims.

Broadly, an embodiment of the present invention provides a systemic basketball dribbling teaching aid software application and methods of use thereof.

The systemic basketball teaching aid software application of the present invention may include at least one computer with a user interface. The computer may include at least one processing unit coupled to a form of memory. The computer may include, but is not limited to, a microprocessor, a server, a desktop, laptop, and smart device, such as, a tablet and smartphone. The computer includes a program product including a machine-readable program code for causing, when executed, the computer to perform steps. The program product may include systemic software which may either be loaded onto the computer or accessed by the computer. The loaded systemic software may include an application on a smart device. The systemic software may be accessed by the computer using a web browser. The computer may access the systemic software via the web browser using the internet, extranet, intranet, host server, internet cloud and the like.

This systemic software application and method help to improve a player's dribbling confidence and ball control, hand/eye coordination, quickness, read and reacting. It also limits the number of turnovers within a game. It is a solution that can be easily understood by players from any country (who may speak different languages) and helps to strengthen the eyes and brain. It brings together basketball, endurance, and speed within a prescribed time limit that requires and develops reading numbers, a quick response, and mental awareness. Advantageously, it can be used by players of any age (including children and adults).

The present invention requires a player to read a series of numbers (e.g., R1, 3, 4, 5), which tells them what moves to make after learning the meaning of these numbers (i.e., each number represents a specific basketball move to make). It allows for the player to keep their eyes on the screen while the numbers are moving around to keep their eyes moving around (e.g., viewing the court). It allows a player to compete against others worldwide, seeing that numbers are known internationally, and the dribbling method is the same everywhere. The present invention additionally provides for people to have friendly competitions. Certain aspects of the present invention include teaching counting K-Adulthood, teaching reading and eye coordination, teaching ball movement, teaching court awareness, and teaching read and react.

Referring now to FIGS. 1, a computer 11 (e.g., a smartphone) runs a mobile application thereon. As shown in FIG. 1, the application displays a first user interface 12. As shown in FIG. 1, a plurality of numbers 13 are displayed on a portion 12A of the screen, and an athlete must follow instructions/basketball moves that correspond to the numbers in a predetermined timeframe. The numbers are representative of different basketball moves. For example, the number 1 could mean a pound dribble straight down (right or left-handed). The number 2 could mean an in/out dribble (right or left-handed). The number 3 could mean dribble between the legs (right or left-handed). The number 4 could mean dribble behind the back (right or left-handed). The number 5 could mean a cross-over dribble (right or left-handed).

Figure 2:
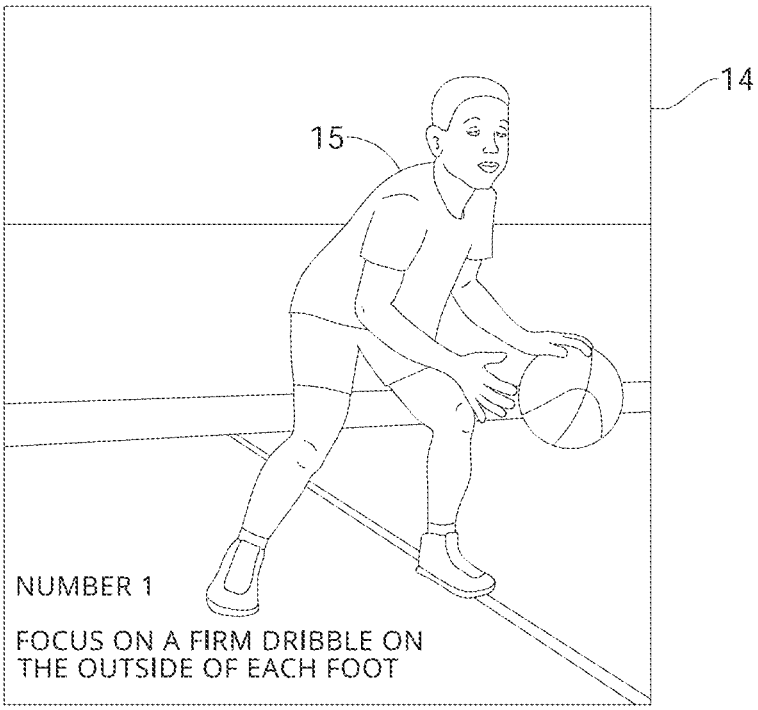
FIG. 2 is a schematic view of another user interface of the embodiment of the present invention, showing an athlete demonstrating a drill once a user subscribes on the "Numbers" tab.
Figure 3:
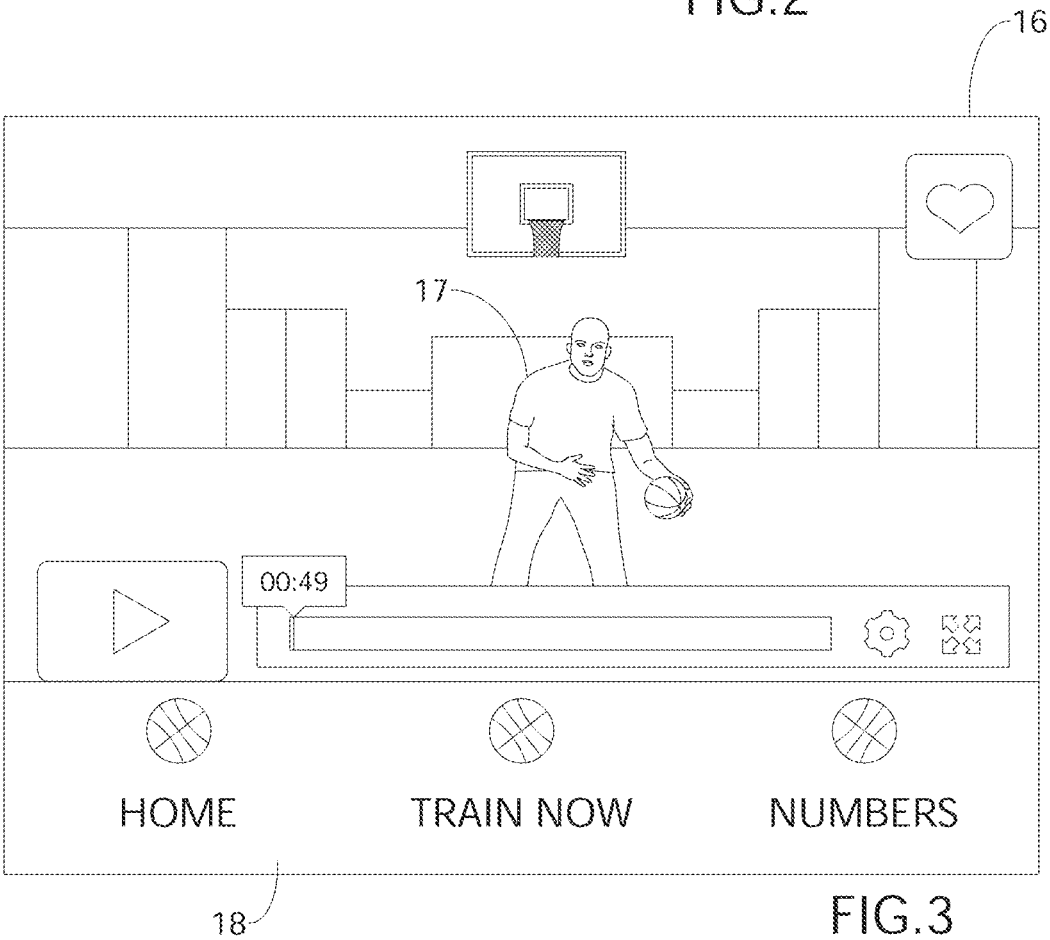
FIG. 3 is a schematic view of another user interface, similar to FIG. 2, showing an instructor demonstrating a drill while giving instruction.

Alternatively (or in addition to), instead of numbers, letters or a series of pictures could denote various basketball moves. For example, as shown in FIG. 2, a second user interface 14 can include a picture or video representation of a player 15 demonstrating a respective drill associated with a number. As shown in FIG. 3, the mobile application may also include a third user interface 16 the displays various videos of an instructor 17 demonstrating how to execute a respective drill. The mobile application may further include a navigation menu 18 that allows its users to switch between interfaces.

As those with skill in the art will appreciate, the order of these numbers/letters/pictures may be varied to test and improve the basketball player's skills/awareness. Further, while the embodiment described focuses on basketball, it may also be appropriate for other sports, such as soccer, boxing, hockey, or other speed and agility related activities, which require a player to learn and utilize multiple moves with a ball throughout a game.

Figure 4:
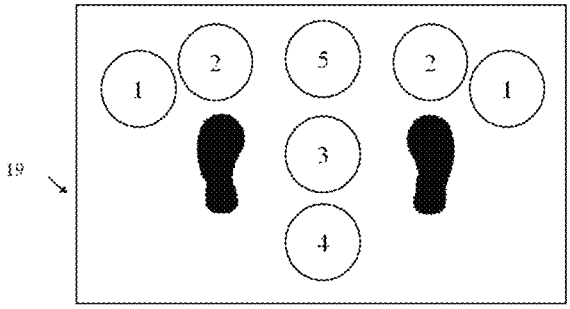
FIG. 4 is a perspective view of a mat of the embodiment of the present invention.

Making reference to FIG. 4, a mat 19 is further provided that allows a user to place their feet thereon, while allowing them to dribble to the code placed in front of them. In certain embodiments, the numbers may be attached to a BLUETOOTH™ sensor that will communicate to the system that the individual is using the correct numbers, using the proper amount of strength, speed, and will track their progress. The mat may be transportable and can be rolled up and used on the go with the ability to dribble on. In certain embodiments, different size mats 19 may be provided for different age players. For example, a youth size mat may roughly 36×48 inches and the adult size may be roughly 50×72 inches.

The present invention works by teaching everyone how to dribble a ball while looking up. One aim of the present invention is to start beginners off learning how to dribble with their heads up, like using basketball goggles. Using the present invention, users will learn the dribbling pattern under a time limit, which will help with endurance, strengthening, and competitions.

In an exemplary embodiment, the systemic software application may be used as follows. A player would acquire this application (such as via downloading) and use it daily to help with their ball-handling skills. An entire basketball team may benefit from the use of the present invention. It can be used to help with speed, endurance, strength, and court awareness.

In an exemplary embodiment, the systemic software application may be developed using the teachings described herein to result in a software application where a player can log on to directly or stream/cast to a television or other viewing device. The systemic software application may be accessed in various ways such as, but not limited to, a website accessed over the internet, an iOS or Android application, or other loaded program on a computing device. In certain embodiments, the numbers are designed to bounce (i.e., move) around the screen, requiring the player to keep their eyes on the screen (and not looking down at the ball). The application may be, for example, run locally on a user's device, or may be hosted on a server and accessible via a web application. Further, in certain embodiments, such as for young youth, a dribbling mat may be provided that is labeled with numbers that has Bluetooth functionality that communicates with the systemic software application.

The present invention facilitates communication with a trainer (via various forms of electronic communication, such as virtually or through internet based messaging), provides multiple numbers up to 6, is appropriate for beginners to advance series, allows for viewing others across the country, allows players to interact with their teammates remotely, and track their progress. One objective of the present invention is to permit interaction between athletes anywhere, allowing for them to compete with other athletes, teammates, or for your coaches viewing. Another objective is to give the coaches the ability to interact with other coaches via a video chatting. They will be able to draw up plays via a coach's board within the systemic software application and share content. Playing online with someone, having coaches view you, or having your teammates practice face to face is optional but could be used to make it better.

The present invention has been described in terms of exemplary embodiments solely for the purpose of illustration. Persons skilled in the art will recognize from this description that the invention is not limited to the embodiments described but may be practiced with modifications and alterations limited only by the spirit and scope of the appended claims.

The computer-based data processing system and method described above is for purposes of example only, and may be implemented in any type of computer system or programming or processing environment, or in a computer program, alone or in conjunction with hardware. The present invention may also be implemented in software stored on a computer-readable medium and executed as a computer program on a general purpose or special purpose computer. For clarity, only those aspects of the system germane to the invention are described, and product details well known in the art are omitted. For the same reason, the computer hardware is not described in further detail. It should thus be understood that the invention is not limited to any specific computer language, program, or computer. It is further contemplated that the present invention may be run on a stand-alone computer system, or may be run from a server computer system that can be accessed by a plurality of client computer systems interconnected over an intranet network, or that is accessible to clients over the Internet. In addition, many embodiments of the present invention have application to a wide range of industries. To the extent the present application discloses a system, the method implemented by that system, as well as software stored on a computer-readable medium and executed as a computer program to perform the method on a general purpose or special purpose computer, are within the scope of the present invention. Further, to the extent the present application discloses a method, a system of apparatuses configured to implement the method are within the scope of the present invention.

What is claimed is:

1. A ball dribbling method comprising the steps of:

providing a device with a graphical user interface;

providing a ball;

providing a mat having a plurality of numbers thereon, each of the plurality of numbers having a sensor configured to track progress;

displaying a first number on the graphical user interface;

performing a first action with the ball based on the displayed first number; and tracking the first action when the ball contacts the sensor corresponding to the first number.

2. The method of claim 1, further comprising the steps of:

displaying a second number on the graphical user interface;

performing a second action with the ball based on the displayed second number; and tracking the second action when the ball contacts the sensor corresponding to the second number.

3. The method of claim 2, wherein the first action is dribbling the basketball straight down.

4. The method of claim 3, wherein the second action is an in and out dribble of the basketball.

5. The method of claim 3, wherein the second action is a between the legs dribble of the basketball.

6. The method of claim 3, wherein the second action is a behind the back dribble of the basketball.

7. The method of claim 3, wherein the second action is a crossover dribble of the basketball.

8. The method of claim 1, wherein the ball is a basketball.

9. The method of claim 1, wherein, after the displaying step, the method further comprises the step of:

moving the first number on the graphical user interface.

10. A ball dribbling system, comprising:

a ball;

a mat having a plurality of indicia, each of the plurality of indicia having a sensor configured to track a progress of a user;

at least one processer, and memory, the memory storing instructions that when executed cause the processor to perform a method, the method comprising:

displaying, via a graphical user interface, at least one indicia matching one of the plurality of indicia, the at least one indicia indicative of at least one action to be performed using the ball; and tracking, via the mat, the at least one action to be performed when the ball contacts the sensor corresponding to the at least one indicia on the mat.

11. The ball dribbling system of claim 10, wherein the at least one action to be performed is one of: dribbling a basketball straight down, an in/out dribble, a dribble between the legs, a dribble behind the back, or a cross-over dribble.

* * * * *